US006202977B1

(12) United States Patent
Chapman

(10) Patent No.: US 6,202,977 B1
(45) **Date of Patent: *Mar. 20, 2001**

(54) METHOD AND APPARATUS TO RESTRAIN OBJECTS

(75) Inventor: Nicholas Joseph Chapman, Pleasanton, CA (US)

(73) Assignee: Darco Trust, Stateline, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/451,983

(22) Filed: Nov. 30, 1999

Related U.S. Application Data

(63) Continuation of application No. 08/276,436, filed on Jul. 18, 1994, now Pat. No. 6,073,900.

(51) Int. Cl.[7] ..... A47B 97/00

(52) U.S. Cl. ..... 248/505; 249/313; 249/230.9

(58) Field of Search ..... 248/505, 230.1, 248/231.85, 313, 230.8, 230.9, 146, 154; 410/49

(56) References Cited

U.S. PATENT DOCUMENTS

| | | | | |
|---|---|---|---|---|
| 1,181,377 | | 5/1916 | Dowell | 248/505 |
| 1,719,029 | | 7/1929 | Starmer | 248/313 X |
| 2,277,738 | | 3/1942 | Wilkinson | 248/313 X |
| 3,241,800 | * | 3/1966 | Richter, III | 248/230.9 |
| 3,894,707 | * | 7/1975 | Heard | 248/231 |
| 4,019,704 | | 4/1977 | Levine | 248/637 |
| 4,955,573 | | 9/1990 | Horvath | 248/313 |
| 5,020,760 | | 6/1991 | Mayr | 248/313 |
| 5,022,624 | | 6/1991 | Hill | 248/274 |
| 5,085,387 | | 2/1992 | Peterson | 248/500 |
| 5,190,260 | | 3/1993 | Daubenspeck | 248/313 |
| 5,344,111 | * | 9/1994 | Gantzert | 248/274 |
| 5,487,518 | | 1/1996 | McCraney | 248/313 |
| 5,607,133 | | 3/1997 | Markham | 248/146 |
| 5,746,405 | | 5/1998 | Dvorak | 248/146 |
| 6,073,900 | * | 6/2000 | Chapman | 248/313 |

FOREIGN PATENT DOCUMENTS

| | | | |
|---|---|---|---|
| 4213821 | 5/1993 | (DE) | 410/97 |

* cited by examiner

*Primary Examiner*—Anita M. King
*Assistant Examiner*—Gwendolyn Baxter
(74) *Attorney, Agent, or Firm*—Roger S. Gaither

(57) ABSTRACT

A method and apparatus for protecting objects from damage during an earthquake or the like which includes fastening brackets to a structure and securing the object to the structure by means of a strap-like member connected to the object and the brackets in such a manner that slight controlled movement of the object is allowed in the nature of a dampening, or shock absorbing action.

30 Claims, 5 Drawing Sheets

METHOD AND APPARATUS TO RESTRAIN OBJECTS

CROSS REFERENCE TO RELATED PATENT APPLICATIONS

This application is a continuation on my prior application Ser. No. 08/276,436 filed by me on Jul. 18, 1994, now U.S. Pat. No. 6,073,900, which prior application is now pending before the USPTO and ready to issue as a U.S. Patent.

BACKGROUND OF THE INVENTION

1. Field of the Invention

This invention is in the general field of restraint of objects to prevent damage due to physical shock, or the like.

The invention is even more particularly in the field of restrain of objects located within structures and the like;

The invention is most particularly in the field of a unique method and apparatus for restraining objects in structures or the like when subjected to severe stress, such as may be caused by an earthquake or other physical impact.

2. Description of the Prior Art

In the past there have been attempts to provide proper restrain for objects such as water heaters, refrigerators, water coolers, cabinets, and the like, as described in the summary of the invention, which follows. In this invention, however, I have provided a unique strap and angular anchoring arrangement. I know of no prior art which approaches this problem in the manner of this invention.

SUMMARY OF THE INVENTION

There is an ever increasing awareness of the damage cause by earthquakes. In addition there is an awareness of the damage caused by other types of physical shock, such as out of control vehicles striking house and the like.

Under such circumstances as an earthquake, or the like, many structures may not be demolished, or even severely damaged. However, the shock will cause unstable articles in the structure to move and suffer considerable damage. A few examples are water heaters, other appliances, cabinets, and the like. In the case of cabinets, it is not uncommon for valuable articles, such a glass, porcelain, and the like to be destroyed.

Some people have attempted to secure there objects which might be susceptible to such damage as has been mentioned, by bolting to a floor or wall—or even to another object. Some have used wires, common electrical conduit of plumbing strapping, and the like, for such restraint. None of the methods and devices of which I am aware has ever been satisfactory. Additionally, such attempts will, in themselves, actually impart additional damage to the objects. Improperly wired, bolted, or otherwise secured objects may be damaged by the very rigid and destructive restraining means.

I have now conceived and developed a method and device which provides extremely effective protection for objects of the nature indicated above.

I have provided unique sets of angle brackets, together with an specially designed strapping which anchors objects securely to walls, or the like, of a structure. One of the important unusual features of this invention is the provision of oval slots, or oversized holes, for the securing of bolts and the like. The bolts and other anchoring devices are round. This combination allows limited movement, which can continue through the continued deflection and movement which is always present in an earthquake or the like. The limited movement provided by this method, which can continue throughout the duration of earth or other movement, provides a dampening effect—much like the effect of a spring, shock absorber, or the like.

It is an object of this invention to provide a method and apparatus to secure, and prevent violent movement of, objects within a structure, or the like, when the structure, or the like, is subjected to unusual physical forces;

Another object is to provide such a method and apparatus which will supply a regulated dampening effect on the secured objects;

Another object is to provide such a method and apparatus which will not, of itself, damage the secured objects.

The foregoing, and other, objects and advantages of this invention will become apparent to those skilled in the art upon reading the description of a preferred embodiment, which follows, in conjunction with a review of the appended drawings.

DESCRIPTION OF A PREFERRED EMBODIMENT

In practicing the method of this invention, the first requirement is to locate the object to be protected in a most desirable position to take advantage of the unique features of this invention.

Figure 1:
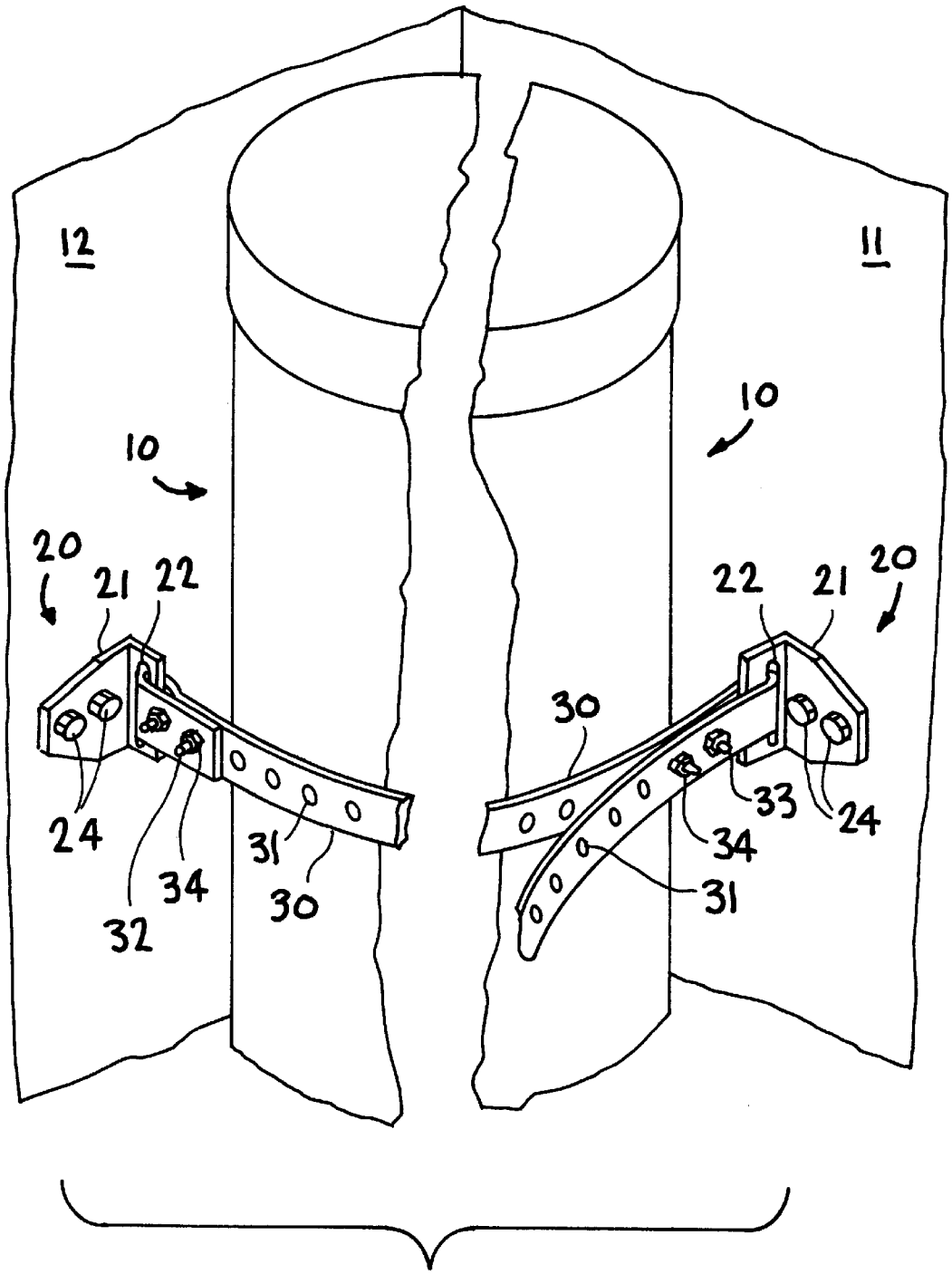
FIG. 1 is a perspective. partially broken away, view of a water heater being secured according to the method of this invention.

In FIG. 1, a highly desirable location for a water heater, or the like 10 is indicated at the intersection of two walls, 11 and 12. The restraining device 20 of this invention is shown partially broken away.

Figure 2:
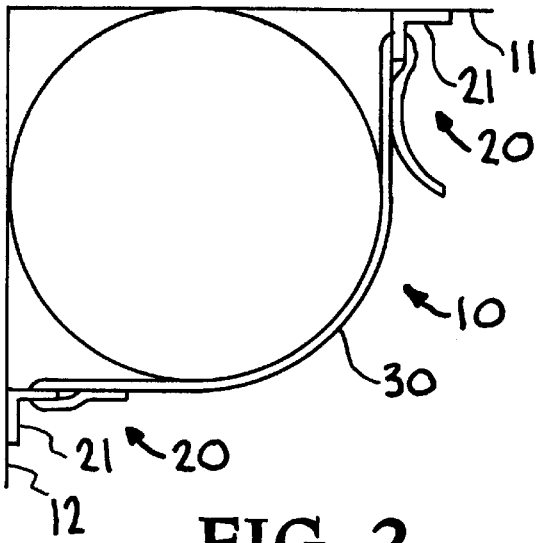
FIG. 2 is a top plan of FIG. 1, in reduced scale, and not broken away.

FIG. 2 shows, from a top plan view, the installation of the apparatus of this invention 20 (some details omitted) to provide proper restraint in case of an earthquake or other disturbance.

Figure 3:
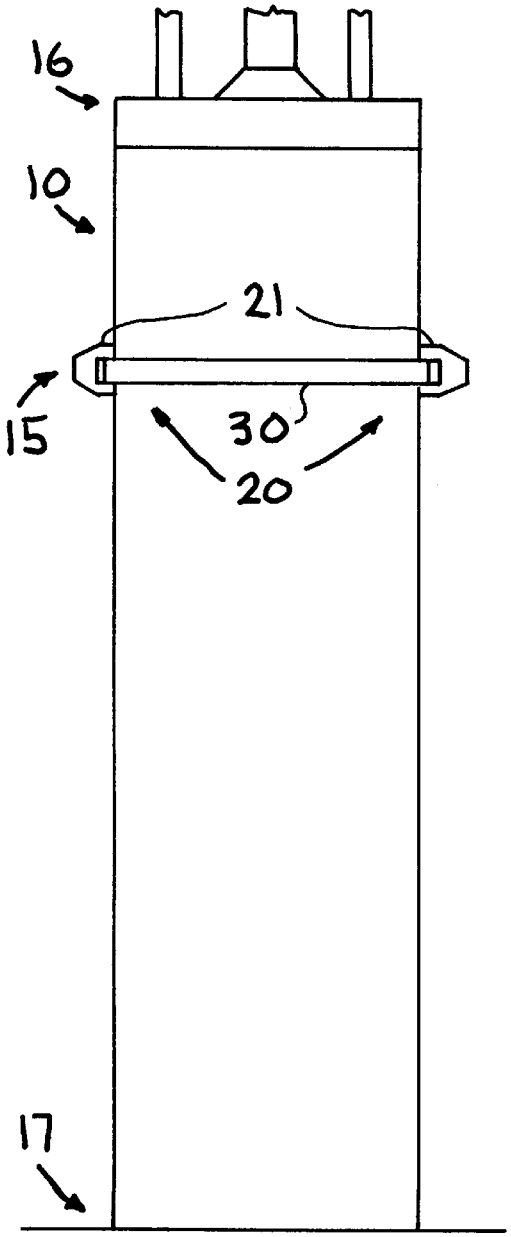
FIG. 3 is view of the complete water heater of FIG. 1, in reduced scale, and not broken away, and indicating the preferred location of the apparatus of this invention in practicing the method of this invention.

FIG. 3 illustrates the ideal vertical location of the restraint 20 of this invention. The top 16 of the restrained device 10 is indicated. The ideal location of the restraining strap and device 20 is shown at 15, which is one third of the distance from the top 16 of the device to the bottom 17, thereof.

Figure 4:
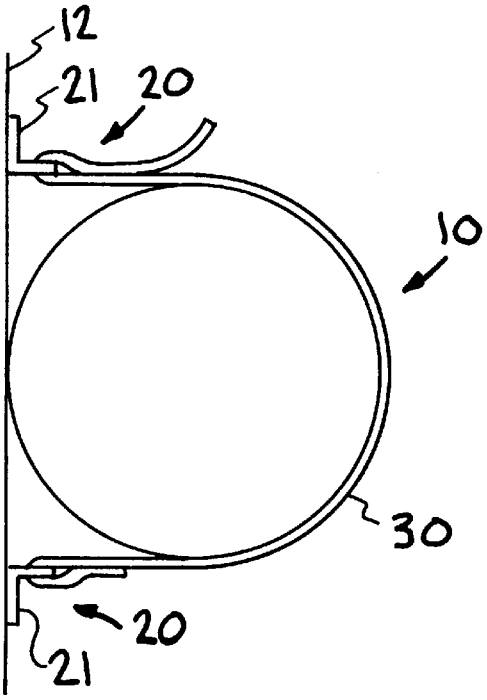
FIG. 4 is a view similar to FIG. 2, but showing a side wall anchorage, rather than a corner as in FIG. 2.

FIG. 4 shows the installation of a water heater along a flat wall, as opposed to the corner installation of FIG. 2.

Figure 5:
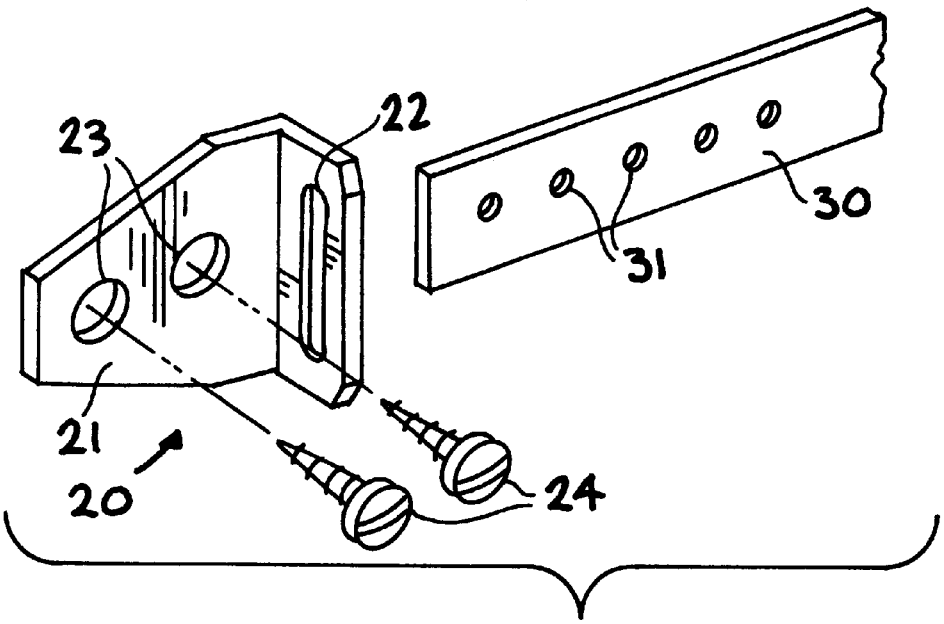
FIGS. 5, 6, 7 & 8 are exploded views, partially broken away, showing the various elements of the apparatus used in the invention.

FIG. 5 shows the elements of a device suitable to practice the method of this invention. The bracket 21 having oversized, or oval holes 23, lag bolts 24, and elongated strap slot 22. The enlarged or oval holes 23 and the elongated slot 22 provide sufficient movement for the dampening, or shock absorbing movement. This can be compared to the wing movement of an aircraft. In riding on an aircraft, it can be observed that the wings actually flop up and down—if this did not happen, they would snap off. The same principle has been applied here, where the minor movement absorbs the shock.

Likewise, the holes 31 in strap 30 are sufficiently enlarged to provide a slight movement under extreme shock.

Figure 6:
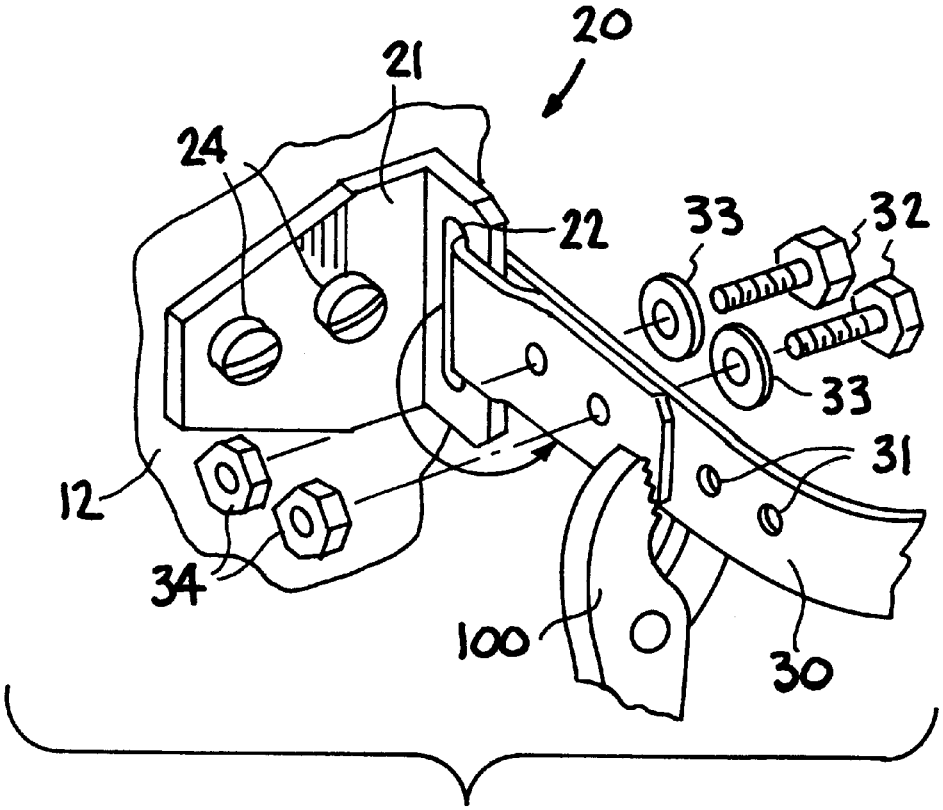

FIG. 6 shows the clamping of the strap 30 through slot 22 by use of pliers 100, or other means. The bolts 32 are inserted through washers 33 and holes 31. They are then secured by nuts 34.

Figure 7:
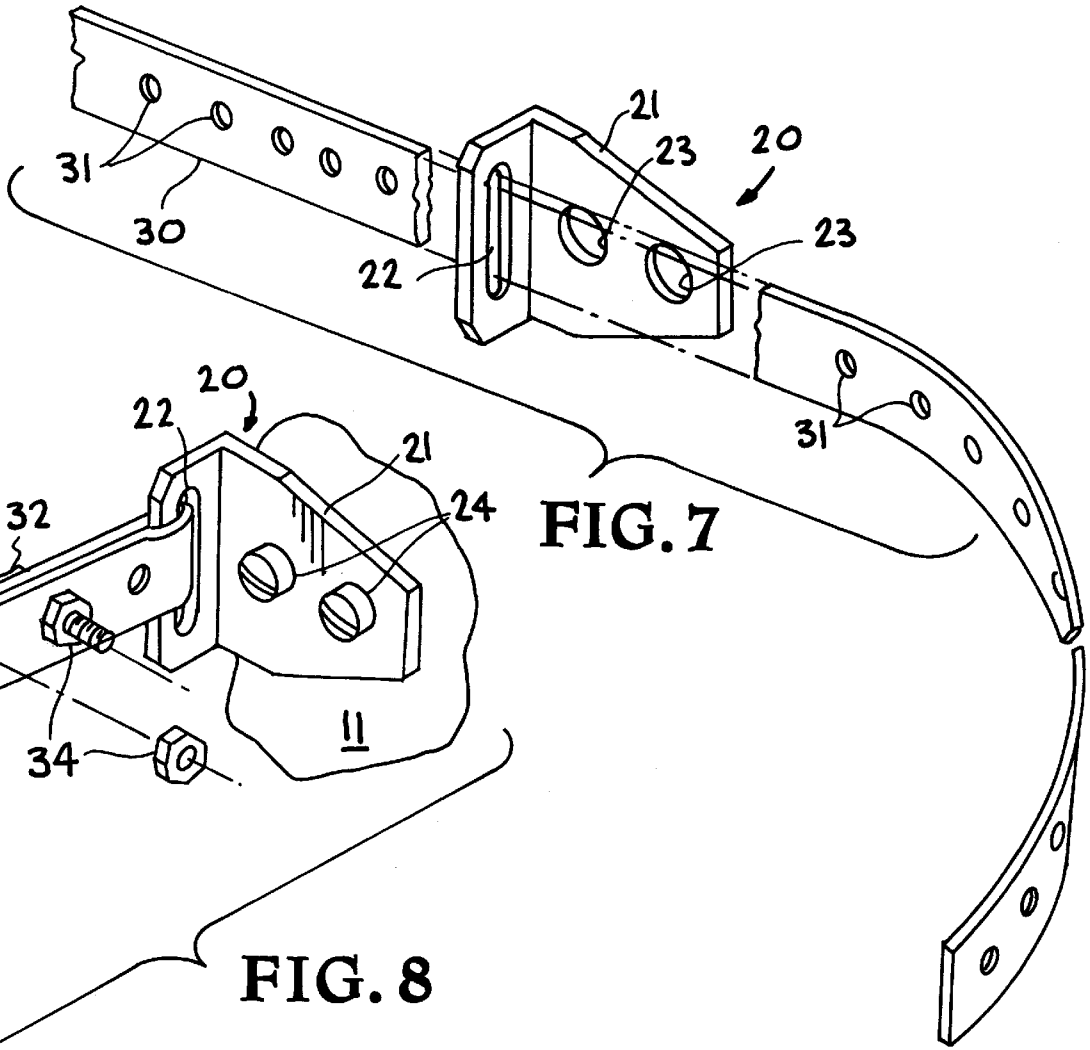
Figure 8:
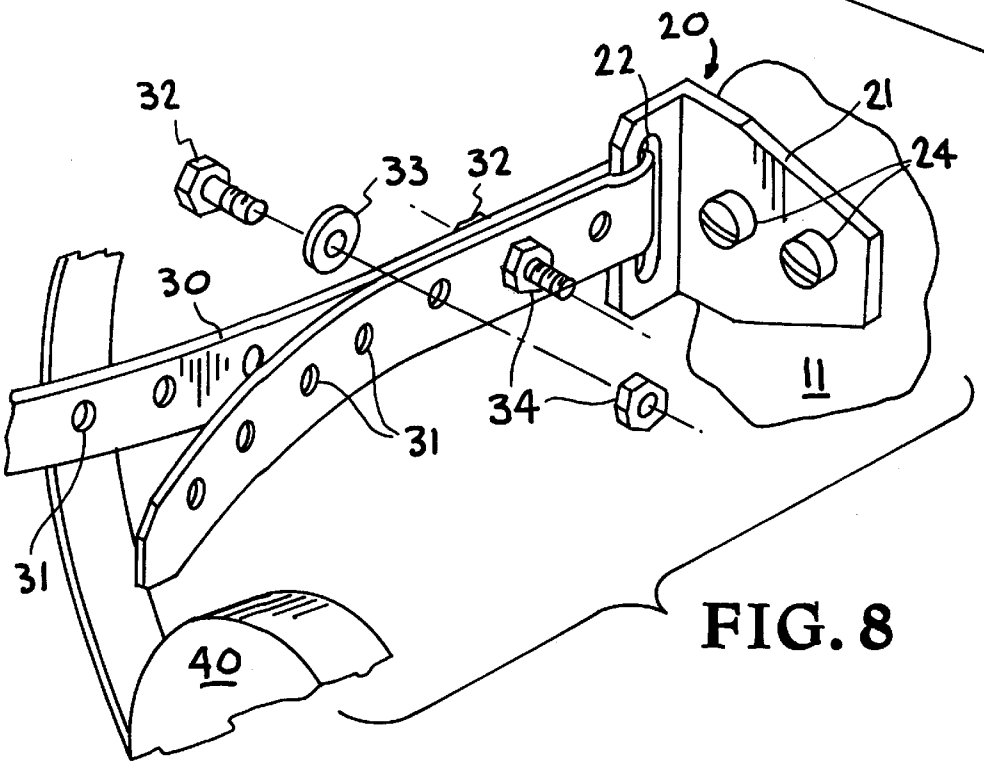

The same elements are indicated at the other end in FIGS. 7 and 8. In FIG. 8 a roll of suitable plastic tape or the like, 40 is shown. This tape is preferably used to encompass the end of the strap so as to avoid injury to one brushing against it, or the like.

Figure 9:
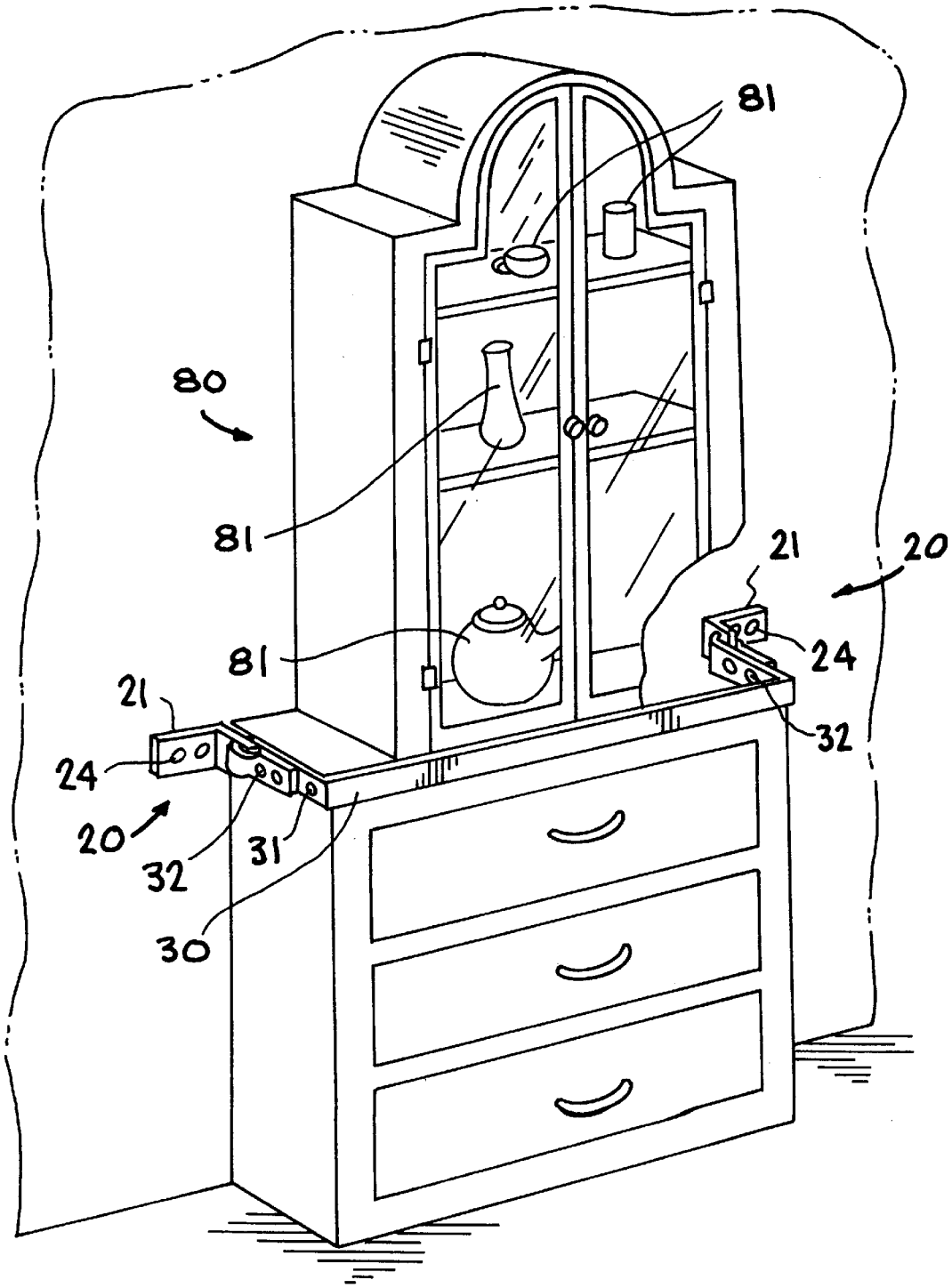
FIG. 9 is a perspective showing the securement of a cabinet by the apparatus and method of this invention.

FIGS. 9 and 10 show this invention in use to protect a cabinet or the like. A cabinet 80 is shown, having porcelain, glass, or other delicate objects 81 in its upper display portion. Presumably, and preferably, the closure of the doors of the display portion will be locked, by means not shown, but well known to those skilled in the art. Likewise the drawers will be locked in customary manner, not shown. In this case, the height of the securing strap will not normally be in the dimensions shown in FIG. 3. The reasons for this are that a study of the normal dimensions and centers of gravity of items such as a cabinet as shown in FIG. 9 will be such that the dimensions and location of the restraint will shift accordingly.

Perhaps a more accurate description of the location of the strap than as indicated in FIG. 3 would be at, or near a position approximating three quarters of the distance of the center of gravity of the object being secured above the base upon which it rests.

I have not described the material of which the brackets, fasteners, straps, and other elements used in this invention are composed. This is only of importance in evaluating the strength required in each instance. For most applications I find that stainless steel is ideal. Stainless steel has many desirable qualities, including resistance to deterioration by reason of oxidation and the like. However, certain other materials are fully suitable, and the ever evolving technology, new and distinct materials may be even more desirable. Those skilled in the art will be able to implement the principles of this invention by substituting other materials.

The embodiments and materials recited herein are only for purposes of illustration, and not for the purposes of limitation. It is intended that this invention be evaluated and its principles included in all of its basic concepts and without limitation to specifics.

I claim:

1. An apparatus to restrain movement of an object associated with a structure which is subject to severe physical shock including:

first and second brackets; each bracket having at least one elongated slot and at least one hole therein; each bracket can be bolted to a different portion of the structure by at least one bolt passing through said at least one hole in each of said brackets and into the structure; each of said at least one hole is enlarged with respect to the size of said at least one bolt; a strap-like member having a width, a first end and a second end; one end of said straplike member is secured to one of said brackets after the stra-like member is passed through the at least one elongated slot in said one of said brackets, and each of said at least one elongated slot is longer than the width of the straplike, whereby said apparatus provides for a dampening of the movement of the object when the object is subjected to severe physical force.

2. The apparatus of claim 1 including said one end of said strap-like member is passed through the at least one elongated slot in one of the brackets and is then bent backwards against and around a portion of that bracket to engage and hold the strap-like member in contiguous contact with the at least one elongated slot.

3. The apparatus of claim 1 including means to permit a controlled amount of movement of the object relative the structure and thereby provide a dampening effect so as to restrain the object undergoing the severe physical shock, wherein said means comprises said first bracket being formed from a type of sheet metal material; said first bracket containing a first plane, a second plane and with an angle there between; the first plane contains the at least one hole in the first bracket; and the angle between the first plane and the second plane can change when the strap-like member pulls against the first bracket as the object undergoes severe physical shock during a natural disaster.

4. The apparatus of claim 1 including separate fastener means to securely hold said strap-like member in contact with said at least one of the brackets;and at least one fastener in engagement with a selected end of said strap-like member to secure said selected end to a different portion of the strap-like member after that selected end has been passed through the at least one elongated slot in one said brackets.

5. The apparatus of claim 1 including a plurality of fastener means for engaging each end of the strap-like member to secure each end to a different part of the strap-like member after each end has passed through an elongated slot in one of said brackets.

6. The apparatus of claim 1 further including said first bracket and said second bracket have substantially the same shape so that each bracket can be interchanged with the other bracket.

7. The apparatus of claim 1 further including said first and second brackets are to be bolted directly to the structure; and said strap-like member is to be secured to both the first bracket and said second bracket while said first and second brackets are bolted directly to the structure to thereby restrain movement of the object when the structure is subject to severe physical shock.

8. An apparatus to restrain movement of an object associated with a structure which is subject to severe physical shock including at least two elongated bolts; two brackets with each bracket having at least one aperture and at least one hole therein, which hole is oversized and enlarged with respect to the bolt; a strap-like member that passes around a portion of the object to be restrained; the strap-like member having a plurality of openings therein; each aperture has a transverse dimension with respect to its bracket that is greater than the width of the strap-like member; the strap-like member passes through the at least one aperture to engage its bracket and to hold the strap-like member within that aperture; and each bolt passes through one of the oversized holes in the brackets to thereby hold the brackets against the structure and restrain movement of the object relative to the structure, whereby said apparatus provides for a dampening of the movement of the object when the object is subjected to severe physical force.

9. The apparatus of claim 8 including the strap-like member passing through the at least one aperture and then being bent backwards against and around a portion of its bracket to engage and to hold the strap-like member in that aperture.

10. The apparatus of claim 9 further including at least one fastener to engage at least one of said openings in the strap-like member to hold the strap-like member and at least one of the brackets in contiguous relationship.

11. The apparatus of claim 10 further including each bolt securing the strap-like member and a bracket against the structure.

12. The apparatus of claim 8 further including means to permit a controlled amount of movement of the object relative the structure and thereby provide a danpening effect so as to restrain the object undergoing the severe physical shock, wherein said means comprises each bracket being formed from a type of sheet metal material; each bracket containing a first plane, a second plane and with an angle there between; the first plane contains the at least one hole in the first bracket; the second plane contains the at least one aperture; and the angle between the first plane and the second plane can change when the strap-like member pulls against the bracket as the object undergoes severe physical shock during a natural disaster.

13. An apparatus to restrain movement of an object associated with a structure which is subject to severe physical shock during a natural disaster including, in useful and cooperative relationship: at least two elongated bolts; at least two brackets, each bracket having at least one hole therein; each of said at least one hole is enlarged with respect to the size of the elongated bolts so that said bolts can pass through the holes in the brackets; a strap-like member having a plurality of openings therein and being in contact with a portion of the object to be restrained; and each of these at least two brackets being in engaging relationship with the strap-like member and with one of said plurality of openings to secure the strap to the two brackets and thereby restrain the movement of the object relative to the structure; and threaded bolt means to apply tension on the strap-like member and hold the strap-ike member against the object being restrained, whereby said apparatus provides for a dampening of the movement of the object when the object is subjected to severe physical force.

14. An apparatus to restrain movement of an object associated with a structure which is subject to severe physical shock including: at least two elongated bolts; a first bracket having at least one hole that is enlarged with respect to the size of said at least one bolt; a second bracket having at least one hole that is enlarged with respect to the size of said at least one bolt; a strap-like member having a plurality of openings therein, a first end and a second end; a plurality of fastener means for engaging the plurality of openings in the strap-like member; the first end of the strap-like member is secured to said first bracket; the second end of the strap-like member is secured to said second bracket; and each of said brackets is securely engaged by one of the bolts attaching directly to the structure and thereby holding the strap-like member against the object to be restrained, whereby said apparatus provides for a dampening of the movement of the object when the object subjected to severe physical force.

15. Apparatus to restrain movement of an object associated with a structure which is subject to severe physical shock including: a first bracket having at least one hole and a first elongated slot therein; said first elongated slot having a slot length and a slot width, where the slot length is greater than the slot width; a first bolt being of a size such that a portion of the first bolt passes through and is secured in said hole in the first bracket; said hole in the first bracket is enlarged with respect to the size of the bolt; a strap-like member having a first end, a second end, and a strap width, where the slot length is greater than the strap width; the first end of the strap-like member passes through the first elongated slot and is held against the first bracket; said first bolt securing the first bracket to the structure; at least one opening in the strap-like member located adjacent to one end of the strap-like member; and a fastener means that passes through said at least one opening in the strap-like member to secure the strap-like member thereby restrain movement of the object relative to the structure, whereby said apparatus provides for a dampening of the movement of the object when the object subjected to severe physical force.

16. The apparatus of claim 15 including the elongated bolt securing the strap-like member and first bracket in a fixed relationship relative to the object and the structure.

17. The apparatus of claim 16 including a second bracket having at least one hole and a second elongated slot therein; a second bolt of a size such that a portion of the second bolt passes through and is secured in said at least one hole in the second bracket; said at least one hole in the second bracket is enlarged with respect to the size of the second bolt; the second end of the strap-like member passes through the second elongated slot and is held against the said second bracket.

18. The apparatus of claim 15 further including at least two opening in the strap-like member.

19. The apparatus of claim 18 including at least two fastener means where each fastener means pass through different one of said at least two opening in the strap-like member to secure the strap-like member against the object and thereby restrain movement of the object relative to the structure.

20. The apparatus of claim 19 some of the at least two fastener means secure the strap-like member to said first bracket.

21. The apparatus of claim 15 including means to permit a controlled amount of movement of the object relative the structure and thereby provide a dampening effect so as to restrain the object undergoing the severe physical shock, wherein said means comprises said first bracket being formed from a type of sheet metal material; said first bracket containing a first plane, a second plane and with an angle there between; the first plane contains the at least one hole in the first bracket; and the angle between the first plane and the second plane can change when the strap-like member pulls against the first bracket as the object undergoes severe physical shock during a natural disaster.

22. A method of restraining an object located within a structure from violent movement occurring during a natural disaster comprising:

a. providing at least two brackets, each bracket having at least one hole and at least one elongated slot therein, b. providing an elongated strap-like member having two ends, and c. providing at least two elongated bolts;

d. securing each end of the strap-like member to one of the brackets;

e. placing the strap-like member around a portion of the object to be restrained so that said object is in contiguous contact with the strap-like member located between said structure and said strap-like member;

f. attaching each of said brackets to the structure by means of said bolts passing through said holes in the brackets and into the structure;

g. securing the strap-like member against the object to be restrained so that said object is held in contact with the stra like member and said structure;

h. providing for a dampening of the movement of the object by the bracket undergoing a slight, controlled movement relative to the structure when the structure is subjected to a severe physical shock; and i. providing for a dampening of the movement of the object by the strap-like member undergoing a second slight, controlled movement relative to the structure when the structure is subjected to a severe physical shock.

23. The method of claim 22 wherein the steps of providing for slight, controlled movement of the object relative to the structure consists of the bracket and the strap-like member undergoing a sequence of resisting movement and relaxing, resisting movement and relaxing.

24. The method of claim 22 wherein the step of providing at least one bracket having at least one hole therein firther consists of providing that the hole in the bracket is oversized to allow for bending and movement about the bolt attaching the bracket to the structure.

25. The method of claim 22 further defining the step of securing the strap-like member to the bracket consists of passing the strap through the elongated slot; and the step of providing for the strap-like member to undergo a second slight, controlled movement relative to the structure further consists of the elongated slot being deformed by the strap-like member when the structure is subjected to a violent physical shock during a natural disaster.

26. The method on claim 22 further defining the step of providing the brackets consists of each bracket having substantially the same shape and configuration so the brackets can be interchanged.

27. The method on claim 22 further defining the step of providing the strap-like member consists of the strap-like member having a plurality of openings therein.

28. An apparatus to restrain movement of a water heater relative to the walls of a structure having walls, which structure is subject to severe physical shock from a natural disaster such as an earthquake, including: two brackets; each bracket having substantially the same shape and configuration; each bracket having at least one elongated slot and at least one hole therein; at least two elongated bolts which can be used to attach the brackets to a wall of the structure by having each bolt passing through a hole in a different one of the brackets and into the wall; a strap-like member having a width and two ends; each end of said strap-like member is secured to different one of the brackets after the strap-like member is passed through the at least one elongated slot in bracket and is then bent backwards against and around a portion of that bracket to engage and hold the strap-like member in contiguous contact with the at least one elongated slot; and each of said at least one elongated slot is longer than the width of the strap-like member, whereby said apparatus provides for a dampening of the movement of the object when the object is adapted to be subjected to severe physical force.

29. The apparatus of claim 28 further including at least two opening in the strap-like member located near the ends of the strap-like member.

30. The apparatus of claim 29 still further including at least two fastener means; and a portion of each fastener means is passed through different one of said at least two opening in the strap-like member to secure each end of the strap-like member to a different portion of the strap-like member after each end has been passed through the at least one elongated slot in one said brackets to keep the strap-like member in contiguous contact with the water heater and restrain movement of the water heater relative to the walls of the structure.

* * * * *